US009976428B2

(12) United States Patent
Snyder

(10) Patent No.: US 9,976,428 B2
(45) Date of Patent: May 22, 2018

(54) TURBINE AIRFOIL ATTACHMENT WITH SERRATION PROFILE

(71) Applicant: United Technologies Corporation, Hartford, CT (US)

(72) Inventor: Daniel Snyder, Manchester, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 615 days.

(21) Appl. No.: 14/853,253

(22) Filed: Sep. 14, 2015

(65) Prior Publication Data

US 2016/0160662 A1 Jun. 9, 2016

Related U.S. Application Data

(60) Provisional application No. 62/089,636, filed on Dec. 9, 2014.

(51) Int. Cl.
*F01D 5/30* (2006.01)

(52) U.S. Cl.
CPC ..... *F01D 5/3007* (2013.01)

(58) Field of Classification Search
None
See application file for complete search history.

(56) References Cited

U.S. PATENT DOCUMENTS 4,260,331 A * 4/1981 Goodwin ..... F01D 5/3007 416/219 R
4,824,328 A * 4/1989 Pisz ..... F01D 5/3007 416/219 R

* cited by examiner

*Primary Examiner* — Christopher Verdier
*Assistant Examiner* — Kayla McCaffrey
(74) *Attorney, Agent, or Firm* — Snell & Wilmer, L.L.P.

(57) ABSTRACT

An attachment root of an airfoil is provided. The attachment root may comprise a serration profile, a symmetry plane bisecting the serration profile, and a line perpendicular to the symmetry plane. A first lobe of the serration profile may have a first contact face angled 135 degrees from the line. A second lobe of the serration profile may have a second contact face angled 135 degrees from the line. A third lobe of the serration profile may have a third contact face angled 135 degrees from the line.

20 Claims, 3 Drawing Sheets

TURBINE AIRFOIL ATTACHMENT WITH SERRATION PROFILE

CROSS-REFERENCE TO RELATED APPLICATIONS

This application is a nonprovisional of, and claims priority to, and the benefit of U.S. Provisional Application No. 62/089,636, entitled "TURBINE AIRFOIL ATTACHMENT WITH SERRATION PROFILE," filed on Dec. 9, 2014, which is hereby incorporated by reference in its entirety.

FIELD OF INVENTION

The present disclosure relates to gas turbine engines, and, more specifically, to an airfoil attachment for rotating airfoils in a gas turbine engine.

BACKGROUND

Airfoils that rotate in gas turbine engines may generally be attached to rotor disks. The rotor disks in turbine sections and compressor sections of a gas turbine engine may rotate at high angular velocities. The resulting centripetal force may place stress on contact points where the airfoil is connected to the rotor. The high stress levels combined with high temperatures may accelerate wear and tear on the airfoil.

SUMMARY

An attachment root of an airfoil is provided. The attachment root may comprise a serration profile, a symmetry plane bisecting the serration profile, and a line perpendicular to the symmetry plane. A first lobe of the serration profile may have a first contact face angled 135 degrees from the line. A second lobe of the serration profile may have a second contact face angled 135 degrees from the line. A third lobe of the serration profile may have a third contact face angled 135 degrees from the line.

In various embodiments, the first contact face may have a first length of 0.070 inches to 0.084 inches. The second contact face may have a second length of 0.055 inches to 0.067 inches. The third contact face may have a third length of 0.047 inches to 0.057 inches.

In various embodiments, the first lobe may comprise a first multi-radial profile with a starting point 0.31 to 0.33 inches from the symmetry plane, and a first segment following the starting point and having a first radius between 0.045 inches and 0.055 inches. A second segment may follow the first segment and have a second radius between 0.125 and 0.135 inches. A third segment may follow the second segment and have a third radius between 0.090 inches and 0.100 inches. The first contact face may follow the third segment. A fourth segment may follow the first contact face. The fourth segment may have a fourth radius between 0.085 inches and 0.095 inches. A fifth segment may follow the fourth segment. The fifth segment may have a fifth radius between 0.025 inches and 0.035 inches. A sixth segment may follow the fifth segment and have a sixth radius between 0.025 and 0.035 inches.

In various embodiments, the second lobe may comprise a second multi-radial profile with a seventh segment following the sixth segment. The seventh segment may have a radius between 0.095 inches and 0.105 inches. The second contact face may follow the seventh segment. An eighth segment may follow the second contact face and have an eighth radius between 0.025 inches and 0.035 inches. A ninth segment may follow the eighth segment and have a ninth radius between 0.020 inches and 0.030 inches. A tenth segment may follow the ninth segment and have a tenth radius between 0.025 inches and 0.035 inches.

In various embodiments, the third lobe may comprise a third multi-radial profile with an eleventh segment following the tenth segment. The eleventh segment may have an eleventh radius between 0.193 inches and 0.203 inches. A twelfth segment may follow the eleventh segment and have a twelfth radius between 0.081 inches and 0.091 inches. A thirteenth segment may follow the twelfth segment and include a thirteenth radius between 0.193 inches and 0.203 inches. The third contact face may follow the thirteenth segment. A fourteenth segment may follow the third contact face and have a fourteenth radius between 0.030 inches and 0.040 inches.

An airfoil may comprise an attachment root comprising a serration profile. The serration profile includes a symmetry plane, a line perpendicular to the symmetry plane, and a first lobe of the serration profile with a first contact face angled 135 degrees from the line. A second lobe of the serration profile includes a second contact face angled 135 degrees from the line. A third lobe of the serration profile has a third contact face angled 135 degrees from the line.

A high-pressure turbine is also provided. The high-pressure turbine may comprise a rotor and an airfoil coupled to the rotor by an attachment root. The attachment root may comprise a profile including a first lobe. The first lobe may include a first contact face comprising a first length of 0.070 inches to 0.084 inches. A second lobe may comprise a second contact face comprising a second length of 0.055 inches to 0.067 inches. A third lobe may include a third contact face comprising a third length of 0.047 inches to 0.057 inches.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The scope of the disclosure is defined by the appended claims. For example, the steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine. As used herein, "forward" refers to the direction associated with the nose (e.g., the front end) of an aircraft, or generally, to the direction of flight or motion.

As used herein, "distal" refers to the direction radially outward, or generally, away from the axis of rotation of a turbine engine. As used herein, "proximal" refers to a direction radially inward, or generally, towards the axis of rotation of a turbine engine.

Figure 1:
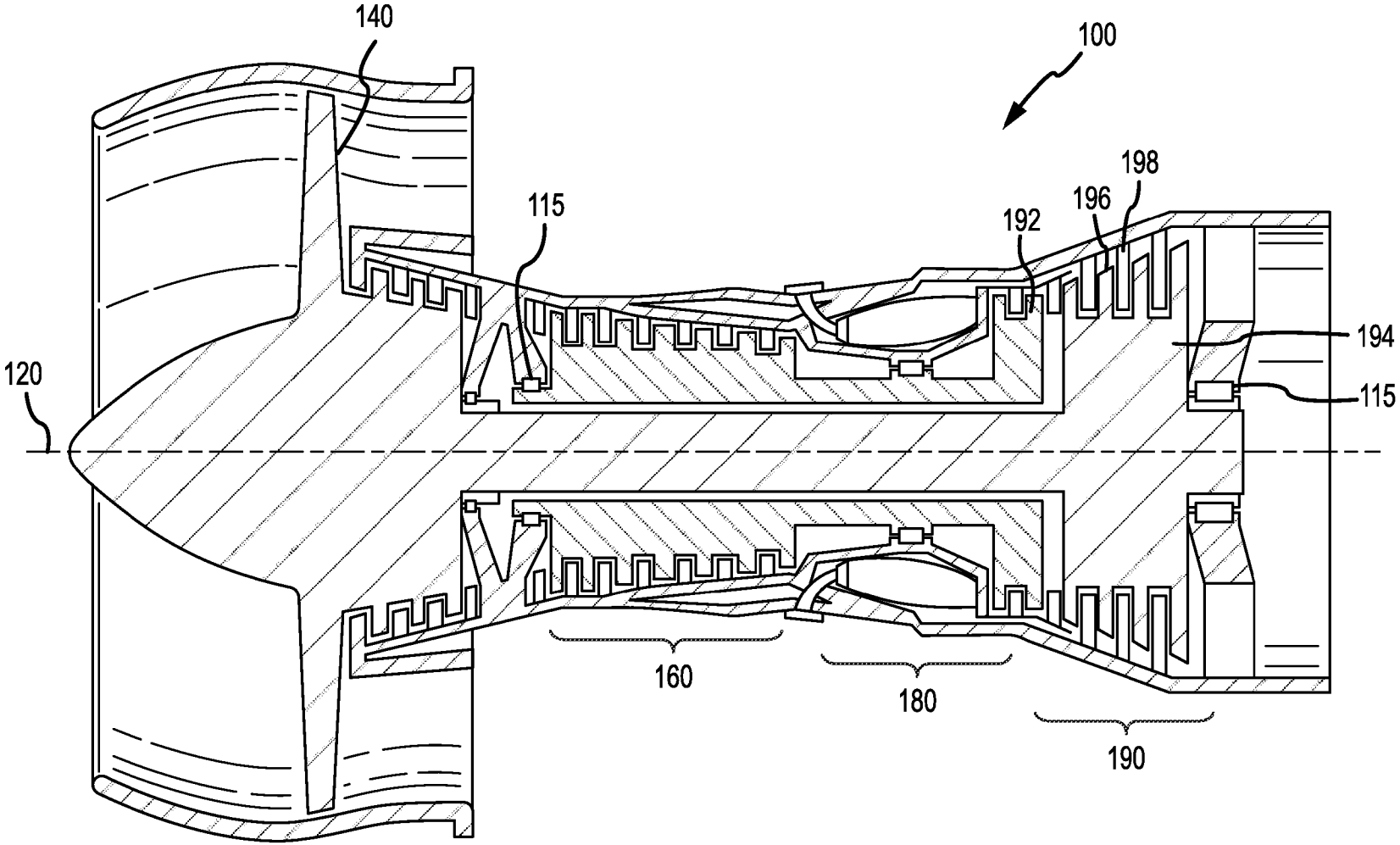
FIG. 1 illustrates a cross-sectional view of an exemplary gas turbine engine, in accordance with various embodiments.

Referring to FIG. 1, a gas turbine engine 100 (such as a turbofan gas turbine engine) is illustrated according to various embodiments. Gas turbine engine 100 is disposed about axial centerline axis 120, which may also be referred to as axis of rotation 120. Gas turbine engine 100 may comprise a fan 140, compressor sections 150 and 160, a combustion section 180, and a turbine section 190. Air compressed in compressor sections 150, 160 may be mixed with fuel and burned in combustion section 180 and expanded across turbine section 190. Turbine section 190 may include high-pressure rotors 192 and low-pressure rotors 194, which rotate in response to the expansion. Turbine section 190 may comprise alternating rows of rotary airfoils or blades 196 and static airfoils or vanes 198. Airfoils 196 may be inserted into high-pressure rotors 192 or low-pressure rotors 194 and retained be a root having a serration profile. A plurality of bearings 115 may support spools in the gas turbine engine 100. FIG. 1 provides a general understanding of the sections in a gas turbine engine, and is not intended to limit the disclosure. The present disclosure may extend to all types of turbine engines, including turbofan gas turbine engines and turbojet engines, for all types of applications.

The forward-aft positions of gas turbine engine 100 lie along axis of rotation 120. For example, fan 140 may be referred to as forward of turbine section 190 and turbine section 190 may be referred to as aft of fan 140. Typically, during operation of gas turbine engine 100, air flows from forward to aft, for example, from fan 140 to turbine section 190. As air flows from fan 140 to the more aft components of gas turbine engine 100, axis of rotation 120 may also generally define the direction of the air stream flow.

Figure 2:
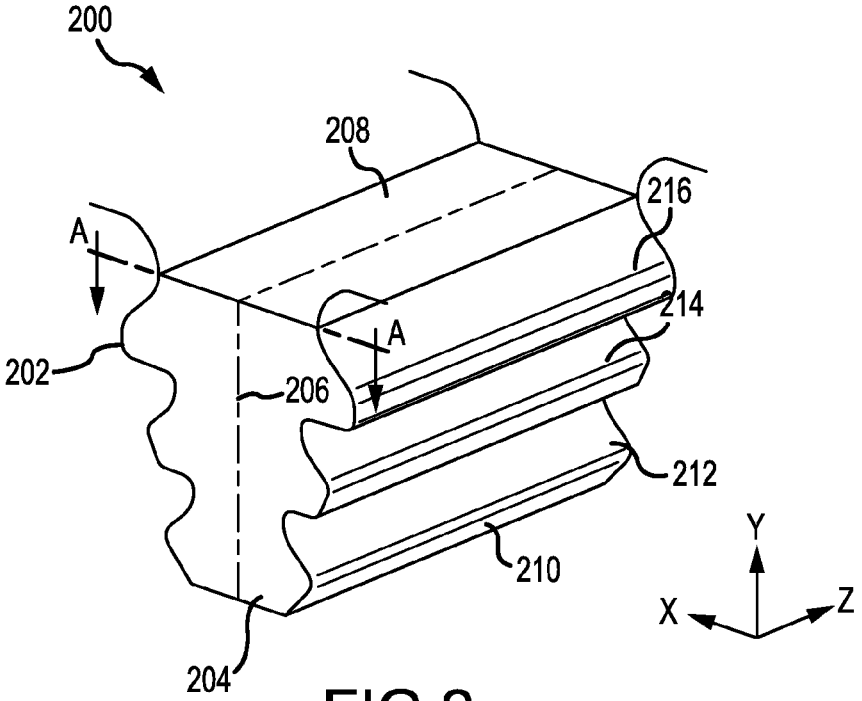
FIG. 2 illustrates a perspective view of an airfoil attachment root, in accordance with various embodiments.

With reference to FIG. 2, an attachment root 200 for an airfoil (e.g., airfoil 196 of FIG. 1) is shown, in accordance with various embodiments. Attachment root 200 comprises a serration profile 202 defining a boundary face 204 having a planar contour. Cross-sectional boundary 208 may be adjacent to boundary face 204 and serve as a radial boundary between attachment root 200 and an airfoil formed integrally to attachment root 200. Cross-sectional boundary 208 may have a planar contour. A symmetry plane 206 may bisect the boundary face 204 and cross-sectional boundary 208. In various embodiments, attachment root 200 may be formed by casting with serration profile 202, further refined by milling, electrochemical machining (ECM), or electrostatic discharge machining (EDM) as desired, for example. In that regard, the attachment root and air foil may be made from a high performance austenitic nickel alloy (e.g., a nickel alloy available under the trademark INCONEL).

In various embodiments, serration profile 202 may extend in the z direction and define interface surface 210. Interface surface 210 may comprise proximal contact face 212, medial contact face 214, and distal contact face 216. Each contact face may be substantially flat in the z direction. Serration profile 202 may be matched with a retention groove formed in a rotor. In that regard, proximal contact face 212, medial contact face 214, and distal contact face 216 may be configured to contact a rotor and retain attachment root 200 in the rotor while limiting wear during use. Each contact face of interface surface 210 may be separated by a radial or multi-radial portion of interface surface 210. Interface surface 210 may be bilaterally symmetric with respect to symmetry plane 206.

Figure 3:
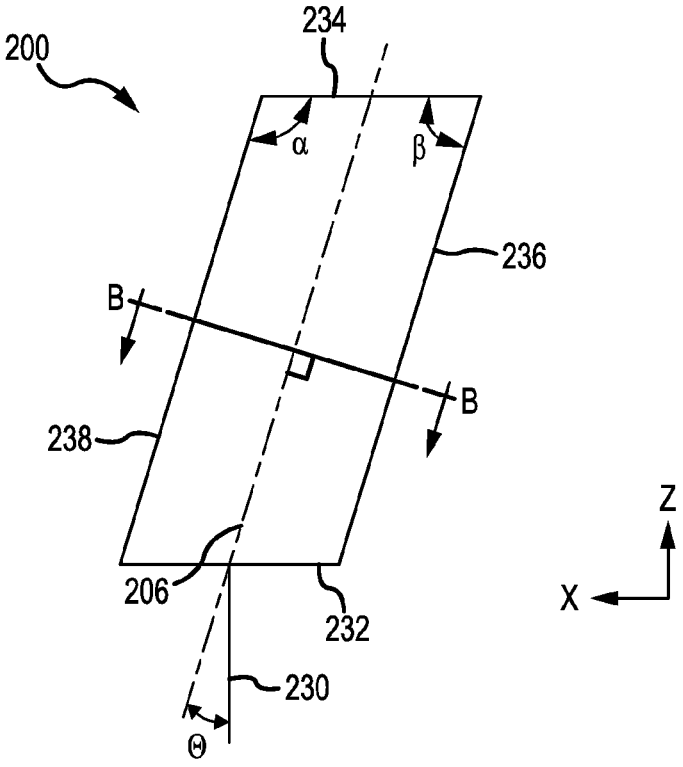
FIG. 3 illustrates a top view of an airfoil attachment root, in accordance with various embodiments.

With reference to FIG. 3, an attachment root 200 is shown in a top view relative to engine center line 230 of a gas turbine engine (e.g., axis of rotation 120 of gas turbine engine 100 from FIG. 1), in accordance with various embodiments. Attachment root 200 in FIG. 3 is shown as viewed in the x-z plane (of FIG. 2) passing through line A (of FIG. 2). Attachment root 200 may have an angle $\theta$ with respect to engine center line 230. For example, the angle between engine center line 230 and symmetry plane 206 may be approximately 10° when attachment root 200 is installed in a gas turbine engine. Axial boundary 232 and axial boundary 234 of cross-sectional boundary 208 may be disposed at a non-90° angle relative engine center line 230. Similarly, an angle $\alpha$ between the axial boundary 234 and boundary 238 may be approximately 100°, and an angle $\beta$ between axial boundary 234 and boundary 236 may be approximately 80°. In that regard, cross-sectional boundary 208 of attachment root 200 may have a parallelogram geometry with axial boundary 232 and axial boundary 234 orthogonal to engine center line 230.

Figure 4:
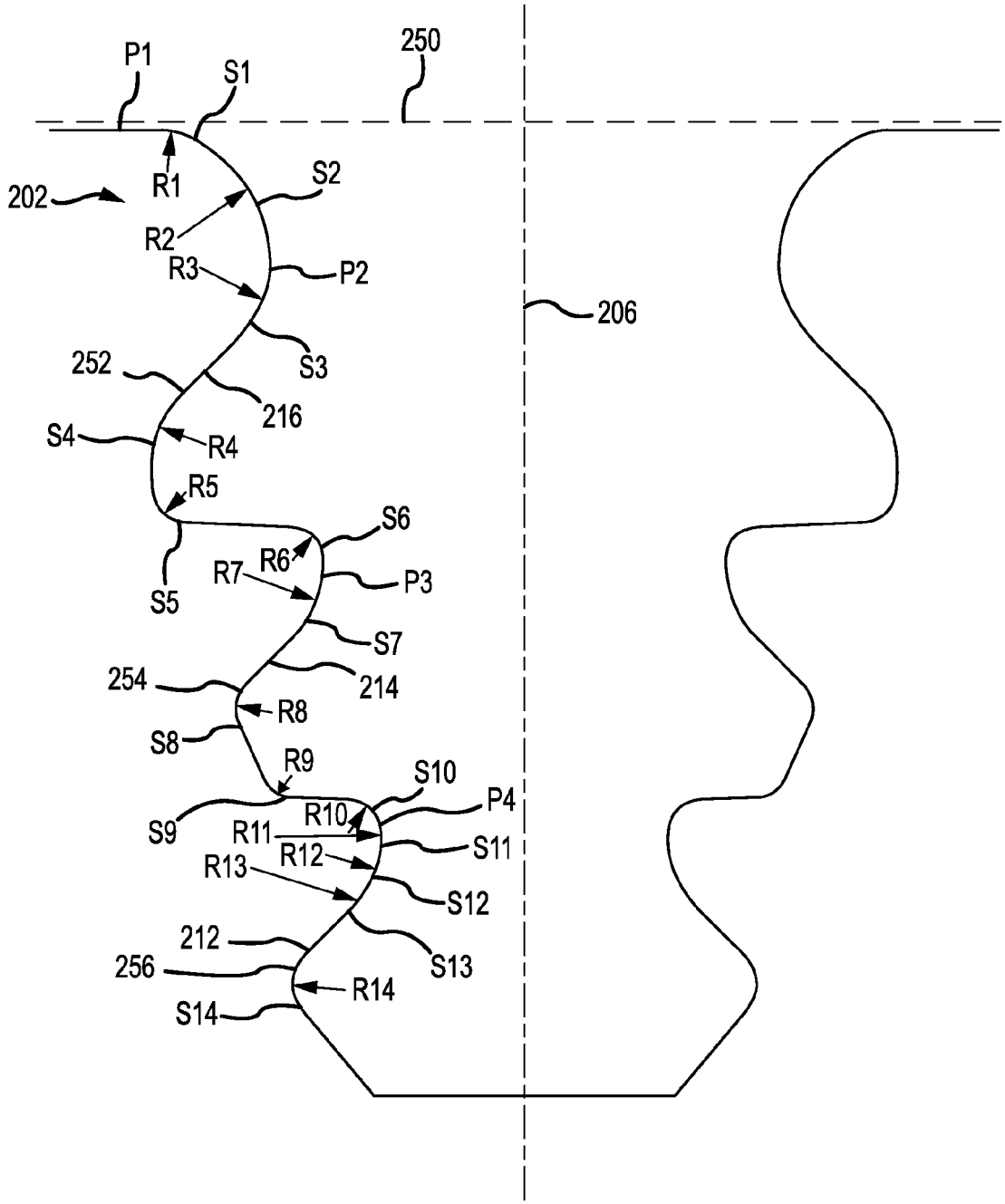
FIG. 4 illustrates a serration profile of an airfoil attachment root, in accordance with various embodiments.

With reference to FIG. 4, a serration profile 202 of an attachment root 200 is shown, in accordance with various embodiments. Serration profile 202 may be the cross-sectional profile of attachment root 200 taken through line B of FIG. 3. As described herein, serration profile 202 may be tangentially continuous between arcs and flat portions. Angles described with reference to FIG. 4 refer to the angle between a tangential line to serration profile 202 and line 250 orthogonal to symmetry plane 206. Serration profile 202 may include distal contact face 216, medial contact face 214, and proximal contact face 212 each defined by a different lobe of serration profile 202. The radii R1-R14 defined herein may vary within a range as provided in table T1. The lengths of segments S1-S14 and flat portions may vary by +/−10%. Similarly, the angles provided may vary by +/−2°. For example, substantially 135° may refer to an angle in the range of 133°-137°.

TABLE T1

Minimums and maximums for radii R1-R14.

| Radius | Min (inches) | Max (inches) | Min (mm) | Max (mm) |
|---|---|---|---|---|
| R1 | 0.045 | 0.055 | 1.143 | 1.397 |
| R2 | 0.125 | 0.135 | 3.175 | 3.429 |
| R3 | 0.090 | 0.100 | 2.286 | 2.540 |
| R4 | 0.085 | 0.095 | 2.159 | 2.413 |
| R5 | 0.025 | 0.035 | 0.635 | 0.889 |
| R6 | 0.025 | 0.035 | 0.635 | 0.889 |
| R7 | 0.095 | 0.105 | 2.413 | 2.667 |
| R8 | 0.025 | 0.035 | 0.635 | 0.889 |
| R9 | 0.020 | 0.030 | 0.508 | 0.762 |
| R10 | 0.025 | 0.035 | 0.635 | 0.889 |
| R11 | 0.193 | 0.203 | 4.902 | 5.156 |
| R12 | 0.081 | 0.091 | 2.057 | 2.311 |
| R13 | 0.193 | 0.203 | 4.902 | 5.156 |
| R14 | 0.030 | 0.040 | 0.762 | 1.016 |

For example, serration profile 202 may comprise a contour as described below. A distal lobe 252 of the serration profile may start from a point P1, which is 0.31 to 0.33 inches (0.79 to 0.84 cm) from symmetry plane 206. From point P1, segment S1 may have a concave arc with radius R1 of 0.050 inches (0.13 cm) extending from an angle 1° from line 250 to an angle 26° from line 250 (the arc of segment S1 extending for 25°). Segment S1 may be tangentially continuous with segment S2. Segment S2 may comprise a concave arc with radius R2 of 0.130 inches (0.33 cm) extending from an angle 26° from line 250 to 90° from line 250 (the arc of segment S2 extending for 64°). The end point P2 of segment S2 may be 0.23 inches (0.58 cm) from symmetry plane 206. P2 may be a local minimum of serration profile 202 in terms of distance from symmetry plane 206.

In various embodiments, end point P2 may be followed by a flat portion measuring 0.001 inches (0.003 cm) in length at angle 90° from line 250 (parallel with symmetry plane 206). Segment S3 may follow the flat portion and have concave arc with radius R3 of 0.095 inches (2.41 cm) extending from 90° to 135° from line 250 (the arc of segment S3 extending for 45°). Segment S3 may be followed by a flat portion measuring 0.077 inches (0.20 cm) in length at angle of 135° from line 250. The flat portion following segment S3 may be distal contact face 216.

In various embodiments, distal contact face 216 may be followed by segment S4 having a convex arc with radius R4 of 0.090 inches (0.23 cm) extending from an angle 135° from line 250 to 86° from line 250 (the arc of segment S4 extending for 49°). Segment S4 may be followed by a flat portion measuring 0.018 inches in length at angle of 86° from line 250. The flat portion may be followed by a segment S5 having a convex arc with radius R5 of 0.030 inches (0.08 cm) extending from an angle of 86° from line 250 to 3° from line 250. Thus, segment S5 may curve through 83°. Segment S5 may be followed by a flat portion measuring 0.10 inches (0.25 cm) in length at an angle 3° from line 250. The flat portion may be followed by segment S6 having a concave arc with radius R6 of 0.03 inches (0.08 cm) and extending from an angle of 3° from line 250 to 90° (segment S6 curving through 87°). End point P3 may be 0.20 inches (0.51 cm) from the symmetry plane 206 and may be a local minimum of serration profile 202 in terms of distance from symmetry plane 206. End point P3 may mark the end of distal lobe 252 of serration profile 202 and the beginning of medial lobe 254 of serration profile 202.

End point P3 may be followed by a flat portion measuring 0.001 inches (0.025 mm) in length at an angle 90° from line 250 (i.e., parallel to symmetry plane 206). The flat portion may be followed by segment S7 having a concave arc with a radius R7 of 0.10 inches (2.4 mm) extending from 90° from line 250 to 135° from line 250 (segment S7 may curve through 45°). A flat section may be between segment S7 and segment S8 and define medial contact face 214. Medial contact face 214 may measure 0.061 inches (1.5 mm) in length at angle 135° from line 250. Segment S8 may follow medial contact face 214 and have a convex arc with radius R8 of 0.030 inches (0.76 mm) extending from 135° from line 250 to 66° below from line 250. Thus, segment S8 may curve through 69°). Segment S8 may be followed by segment S9 having a convex arc with radius R9 of 0.025 inches extending from 65° from line 250 to 3° from line 250 (segment S9 may curve through 63°). Segment S9 may be followed by a flat portion measuring 0.060 inches in length at angle 3° from line 250 with segment S10 following the flat portion. Segment S10 may have a concave arc with radius R10 of 0.030 inches (0.76 mm) extending from an angle 3° from line 250 to 92.6° from line 250 (Segment S10 may curve through 89.6°). End point P4 may be 0.13 inches (3.3 mm) from symmetry plane 206 and is a local minimum. End point P4 may mark the end of medial lobe 254 and the beginning of proximal lobe 256.

In various embodiments, segment S11 may extend from end point P4 and have a concave arc with radius R11 of 0.2 inches extending from an angle 92.6° from line 250 to 97° from line 250 (Segment S11 may curve through 4.4°). Segment S11 may be followed by segment S12 having a concave arc with radius R12 of 0.086 (2.2 mm) inches extending from an angle 97° from line 250 to 128° from line 250 (S12 curving through 31°). Segment S12 may be followed by segment S13 having a concave arc with radius R13 of 0.20 extending from an angle 128° from line 250 to 135° from line 250 (S13 curving through 7°). S13 may be followed by a flat portion that defines proximal contact face 212. Proximal contact face 212 may measure 0.052 inches (1.3 mm) in length angle 135° from line 250. Segment S14 may follow proximal contact face 212 and have a convex arc with radius R14 of 0.035 inches (0.89 mm) extending from 135° from line 250 to 51° from line 250 (S14 curving through 84°). Segment S14 may be followed by a flat portion measuring 0.10 inches in length at an angle of 51° from line 250. Segment S14 may be followed by a tangential discontinuity (i.e., a cusp). A flat portion measuring 0.14 inches (3.6 mm) in length at an angle of 0° from line 250 may then extend to symmetry plane 206 and may mark the end of proximal lobe 256 and serration profile 202.

In various embodiments, the shape of serration profile 202 may improve the strength and wear characteristics of attachment root 200. The lobes of serration profile 202 may be designed to withstand numerous start-up and shut-down sequences while resisting wear. As a result, turbine blades attached to a rotor be attachment root 200 with serration profile 202 may have a longer functional life before replacement.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An attachment root of an airfoil, comprising:
a serration profile;
a line intersecting the serration profile; and
a first lobe of the serration profile with a first contact face angled substantially 135 degrees from the line;
wherein the first lobe comprises a first multi-radial profile comprising
a symmetry plane bisecting the attachment root;
a starting point 0.31 inches to 0.33 inches from the symmetry plane;
a first segment following the starting point and having a first radius between 0.045 inches and 0.055 inches;
a second segment following the first segment and having a second radius between 0.125 inches and 0.135 inches;
a third segment following the second segment and having a third radius between 0.090 inches and 0.100 inches;
the first contact face following the third segment.

2. The attachment root of claim 1, further comprising:
a second lobe of the serration profile with a second contact face angled substantially 135 degrees from the line; and
a third lobe of the serration profile with a third contact face angled substantially 135 degrees from the line.

3. The attachment root of claim 2, wherein the first contact face further comprises a first length of 0.070 inches to 0.084 inches.

4. The attachment root of claim 3, wherein the second contact face further comprises a second length of 0.055 inches to 0.067 inches.

5. The attachment root of claim 4, wherein the third contact face further comprises a third length of 0.047 inches to 0.057 inches.

6. The attachment root of claim 2, wherein the first multi-radial profile further comprises:
a fourth segment following the first contact face and having a fourth radius between 0.085 inches and 0.095 inches;
a fifth segment following the fourth segment and having a fifth radius between 0.025 inches and 0.035 inches; and
a sixth segment following the fifth segment and having a sixth radius between 0.025 inches and 0.035 inches.

7. The attachment root of claim 6, wherein the second lobe comprises a second multi-radial profile comprising:
a seventh segment following the sixth segment and having a radius between 0.095 inches and 0.105 inches;
the second contact face following the seventh segment;
an eighth segment following the second contact face and having an eighth radius between 0.025 inches and 0.035 inches;
a ninth segment following the eighth segment and having a ninth radius between 0.020 inches and 0.030 inches; and
a tenth segment following the ninth segment and having a tenth radius between 0.025 inches and 0.035 inches.

8. The attachment root of claim 7, wherein the third lobe comprises a third multi-radial profile comprising:
an eleventh segment following the tenth segment and having an eleventh radius between 0.193 inches and 0.203 inches;
a twelfth segment following the eleventh segment and having a twelfth radius between 0.081 inches and 0.091 inches;
a thirteenth segment following the twelfth segment and having a thirteenth radius between 0.193 inches and 0.203 inches;
the third contact face following the thirteenth segment; and
a fourteenth segment following the third contact face and having a fourteenth radius between 0.030 inches and 0.040 inches.

9. An airfoil, comprising:
an attachment root comprising a serration profile, wherein the serration profile comprises:
a symmetry plane;
a line perpendicular to the symmetry plane;
a first lobe of the serration profile with a first contact face angled 135 degrees from the line;
a second lobe of the serration profile with a second contact face angled 135 degrees from the line; and
a third lobe of the serration profile with a third contact face angled 135 degrees from the line;
wherein a first profile of the first lobe comprises
a starting point 0.31 inches to 0.33 inches from the symmetry plane;

a first segment following the starting point and having a first radius between 0.045 inches and 0.055 inches;

a second segment following the first segment and having a second radius between 0.125 inches and 0.135 inches;

a third segment following second segment and having a third radius between 0.090 inches and 0.100 inches;

the first contact face following the third segment.

10. The airfoil of claim 9, wherein the first profile of the first lobe further comprises:

a fourth segment following the first contact face and having a fourth radius between 0.085 inches and 0.095 inches;

a fifth segment following the fourth segment and having a fifth radius between 0.025 inches and 0.035 inches; and a sixth segment following the fifth segment and having a sixth radius between 0.025 inches and 0.035 inches.

11. The airfoil of claim 10, wherein a second profile of the second lobe comprises:

a seventh segment following the sixth segment and having a radius between 0.095 inches and 0.105 inches;

the second contact face following the seventh segment;

an eighth segment following the second contact face and having an eighth radius between 0.025 inches and 0.035 inches;

a ninth segment following the eighth segment and having a ninth radius between 0.020 inches and 0.030 inches; and a tenth segment following the ninth segment and having a tenth radius between 0.025 inches and 0.035 inches.

12. The airfoil of claim 11, wherein a third profile of the third lobe comprises:

an eleventh segment following the tenth segment and having an eleventh radius between 0.193 inches and 0.203 inches;

a twelfth segment following the eleventh segment and having a twelfth radius between 0.081 inches and 0.091 inches;

a thirteenth segment following the twelfth segment and having a thirteenth radius between 0.193 inches and 0.203 inches;

the third contact face following the thirteenth segment; and a fourteenth segment following the third contact face and having a fourteenth radius between 0.030 inches and 0.040 inches.

13. The airfoil of claim 12, wherein the first contact face comprises a first length of 0.070 inches to 0.084 inches.

14. The airfoil of claim 13, wherein the second contact face comprises a second length of 0.055 inches to 0.067 inches.

15. The airfoil of claim 14, wherein the third contact face comprises a third length of 0.047 inches to 0.057 inches.

16. A high-pressure turbine, comprising:

a rotor;

an airfoil coupled to the rotor by an attachment root having a profile comprising:

a first lobe including a first contact face comprising a first length of 0.077 inches;

a second lobe including second contact face comprising a second length of 0.061 inches; and a third lobe including a third contact face comprising a third length of 0.052 inches;

wherein the first lobe comprises a first segment having a first radius between 0.045 inches and 0.055 inches;

a second segment following the first segment and having a second radius between 0.125 inches and 0.135 inches;

a third segment following the second segment and having a third radius between 0.090 inches and 0.100 inches;

the first contact face following the third segment.

17. The high-pressure turbine of claim 16, wherein the first lobe further comprises:

a fourth segment following the first contact face and having a fourth radius between 0.085 inches and 0.095 inches;

a fifth segment following the fourth segment and having a fifth radius between 0.025 inches and 0.035 inches; and a sixth segment following the fifth segment and having a sixth radius between 0.025 inches and 0.035 inches.

18. The high-pressure turbine of claim 17, wherein the second lobe further comprises:

a seventh segment following the sixth segment and having a seventh radius between 0.095 inches and 0.105 inches;

the second contact face following the seventh segment;

an eighth segment following the second contact face and having an eighth radius between 0.025 inches and 0.035 inches;

a ninth segment following the eighth segment and having a ninth radius between 0.020 inches and 0.030 inches; and a tenth segment following the ninth segment and having a tenth radius between 0.025 inches and 0.035 inches.

19. The high-pressure turbine of claim 18, wherein the third lobe further comprises:

an eleventh segment following the tenth segment and having an eleventh radius between 0.193 inches and 0.203 inches;

a twelfth segment following the eleventh segment and having a twelfth radius between 0.081 inches and 0.091 inches;

a thirteenth segment following the twelfth segment and having a thirteenth radius between 0.193 inches and 0.203 inches;

the third contact face following the thirteenth segment; and a fourteenth segment following the third contact face and having a fourteenth radius between 0.030 inches and 0.040 inches.

20. The high-pressure turbine of claim 16, further comprising:

a symmetry plane bisecting the attachment root; and a line orthogonal to the symmetry plane, wherein the first contact face is angled 135 degrees from the line.

* * * * *